United States Patent [19]

Thornton, Jr.

[11] 3,963,953

[45] June 15, 1976

[54] COLOR MISMATCH ACCENTUATING DEVICE

[75] Inventor: William A. Thornton, Jr., Cranford, N.J.

[73] Assignee: Westinghouse Electric Corporation, Pittsburgh, Pa.

[22] Filed: Apr. 29, 1975

[21] Appl. No.: 572,815

[52] U.S. Cl. ..... 313/487; 313/227; 313/486

[51] Int. Cl.[2] ..... H01J 63/04

[58] Field of Search ..... 313/485, 486, 487, 502, 313/503, 504, 227

[56] References Cited

UNITED STATES PATENTS 3,875,453 4/1975 Thornton ..... 313/487

*Primary Examiner*—James B. Mullins
*Assistant Examiner*—Darwin R. Hostetter
*Attorney, Agent, or Firm*—W. D. Palmer

[57] ABSTRACT

A device to generate light of a quality which will accent the mismatch in color appearance of objects having different spectral reflectance curves but which appear at least generally similar in color and lightness under illumination by daylight. As there are many objects which match under one illuminant such as daylight, but do not match under other illuminants, there are many applications in which it is desirable to provide for early detection of potential mismatches. This invention generates visible radiation substantially confined to at least two of the 405–435 nm, 475–505 nm, 565–595 nm, and 645–675 nm wavelength ranges, and which preferably has less than 20 percent of the radiations in the 435–465 nm, 525–555 nm and 595–625 nm wavelength ranges.

6 Claims, 7 Drawing Figures

COLOR MISMATCH ACCENTUATING DEVICE

BACKGROUND OF THE INVENTION

The present invention relates to devices (principally lamps) to evaluate the stability or persistence of the color match of similarly colored objects. The device of this invention provides for detection of potential mismatches in colors which appear to match under some illuminants but may not match under other illuminants.

A large number of commercial products owe their customer-acceptance partly to the fact that they match, in color and lightness, some other product or some other part of the same product. Automobile upholstery and body paint are one example. This match should persist acceptably under whatever illuminant the customer may view the product.

Obtaining an initial color match (under daylight, for example) is a difficult and complex industrial problem in the common case where the matching parts are colored by different pigments or consist of different materials. Even after the initial color match under daylight has been achieved, however, a potential mismatch still remains when the products are viewed under different illuminants. A manufacturer may have the product inspected under one or two additional illuminants such as an incandescent lamp or a fluorescent lamp. Considerable effort can be extended in adjusting pigment and dye formations until a satisfactory match persists under all test illuminants. However this still does not eliminate all of the possible mismatches. The colors of the automotive upholstery and paint may be viewed not only under daylight, incandescent lamps, and different types of fluorescent lamps, but also under other lamps such as high pressure sodium lamps, metal halide lamps, and both corrected and uncorrected mercury lamps. If the spectral reflectance curves of the materials are identical, the color match will persist under all illuminants. This, however, is generally not the case and it is generally impractical to make the spectral reflectance curves identical. Thus the manufacturer generally must test for a color match under a large number of lamps and make repeated corrections if he wishes to be sure that the color match will persist under most different illuminants. Even then, it is possible that some other lamp will cause a mismatch.

FIG. 1 shows spectral reflectance curves measured from two yellow materials. While these materials were found by a normal human observer to match in color and lightness when illuminated by average daylight, it can be seen that these spectral reflectance curves are significantly different. FIG. 2 shows the spectral power distributions of the lights reflected (and thus the lights which would enter the eye) from the materials of FIG. 1 when illuminated by average daylight. The normal human eye perceives the two materials as having the same lightness and color despite the fact these spectral power distributions of the lights entering the eye from the two materials are significantly different.

FIG. 3 shows the spectral reflectance curves of two pinkish grey materials. These materials were also found to match in color and lightness when illuminated by average daylight. These materials are more strongly metameric than the materials of FIG. 1; i.e., the potential mismatch under other illuminants is greater because of the large reflectance discrepancies. The reflectance differences (the areas, in the visible region, between the two curves) determine what is called the degree of metamerism. The degree of metamerism is generally a measure of the differences in color and/or brightness between the lights reflected from a pair of objects as the objects are illuminated by various illuminants. The larger the reflectance differences, the larger the possible mismatch. If there is no area between the loops, that is if the two reflectance curves are identical and coincident, the two objects will appear to match under any illuminant.

SUMMARY OF THE INVENTION

The device of this invention generates light of a quality which will accentuate the mismatch in color of objects having different spectral reflectance curves but which appear to match in color under illumination by daylight. As the human eye is far more sensitive to color shift than to changes in lightness, this device is especially useful to produce color shifts for observation by the human eye. The device comprises a light generating medium for generating visible radiations which are substantially confined to at least two of the color-mismatch-accentuating wavelength ranges (two complementary wavelength ranges are not used by themselves, however). The color mismatch accentuating wavelength ranges are 405–435 nm, 475–505 nm, from 565–595 nm and from 645–675 nm. The device also comprises means for energizing the light generation medium to a light generating condition. Preferably visible radiations in the 435–465 nm, 525–555 nm, and 595–625 nm wavelength ranges constitute less than 20 percent of the visible radiations.

BRIEF DESCRIPTION OF THE DRAWINGS

For a better understanding of the invention, reference is made to the accompanying drawings in which.

DESCRIPTION OF THE PREFERRED EMBODIMENTS

Figure 5:
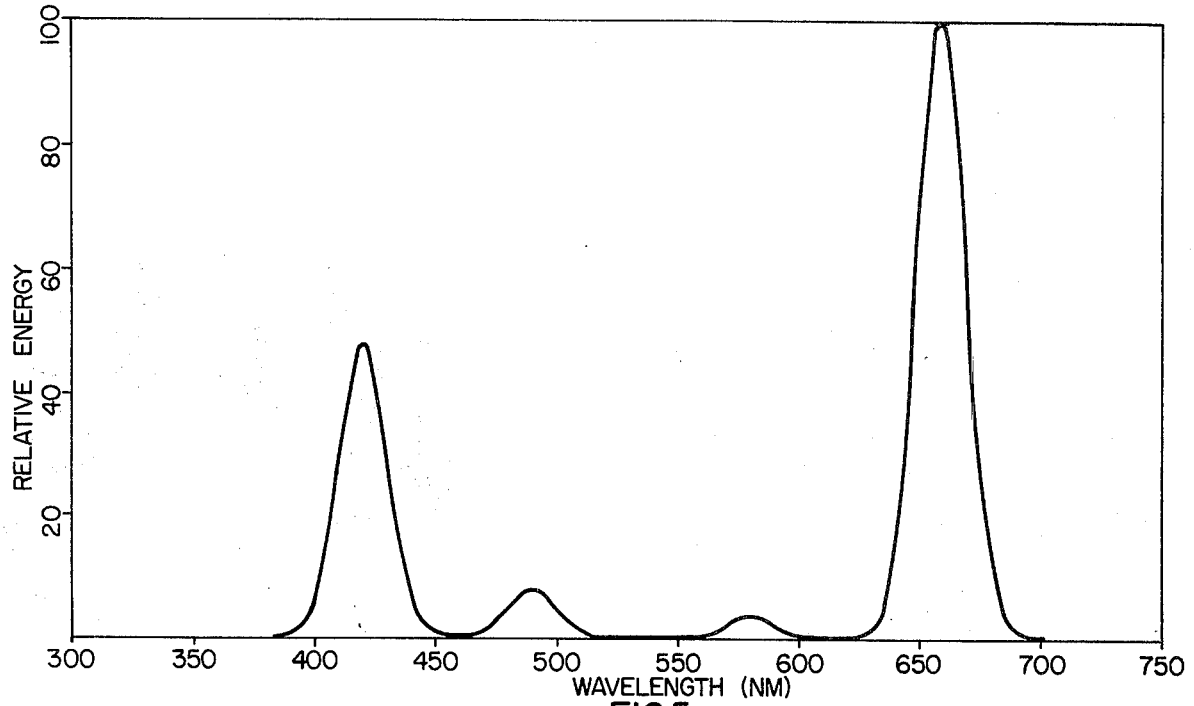
FIG. 5 is a graph of spectral power distribution of a four-component metamer lamp using idealized phosphors but unequal radiations in the four metamer wavelength ranges.
Figure 6:
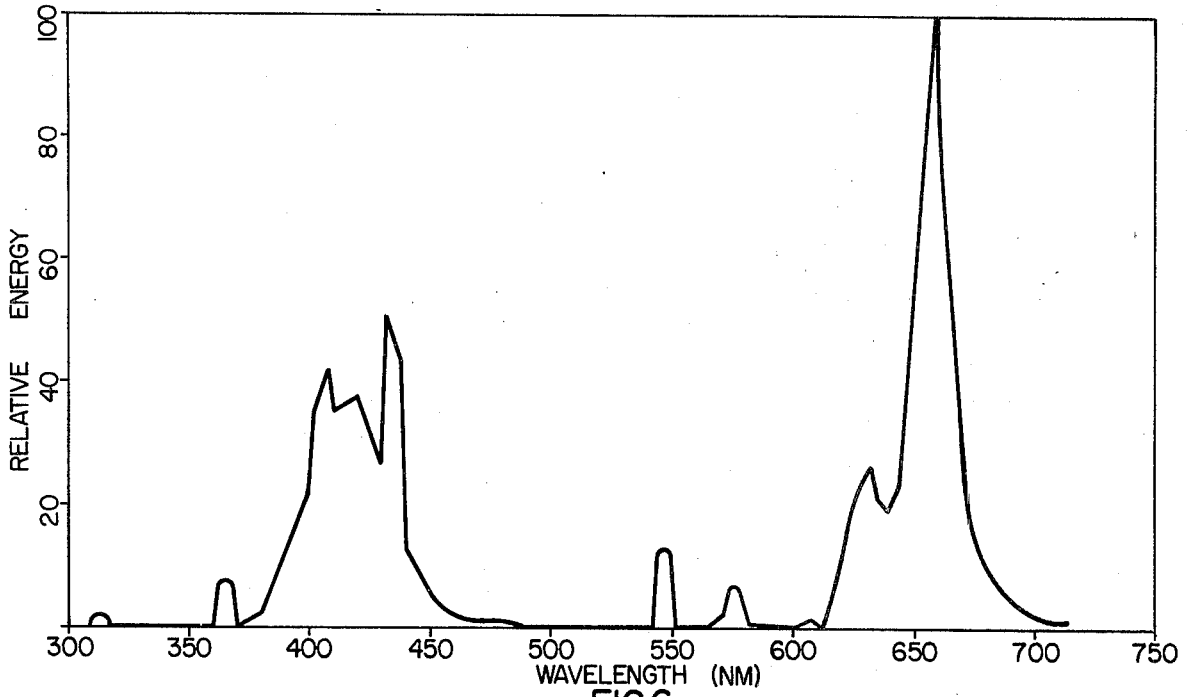
FIG. 6 is a graph of spectral power distribution of a four-component metamer lamp using real phosphors with unequal radiations in the four metamer wavelength ranges; and, FIG. 7 is an elevation partly in section of a preferred embodiment in which the metamer lamp is a fluorescent-type lamp.

The devices of this invention (typically lamps, but possibly other devices such as a combination of lasers) are designed to produce accentuated color shifts and thus provide a reliable method of uncovering potential trouble with objects whose colors are intended to match. These devices use radiations in at least two of the color-mismatch-accentuating wavelength ranges. For convenience, the four color-mismatch-accentuating ("metamer") wavelength ranges will be referred to as M1 through M4; (405–435 nm as M1, 475–505 nm as M2, 565–595 nm as M3, and 645–675 nm as M4). Radiations in at least two of the color mismatch accentuating wavelength ranges are required and satisfactory metamer lamps can be made with radiations in either two, or three, or four of these wavelength ranges. While some color shift or lightness change is obtained using any two of the color-mismatch-accentuating wavelength ranges, a lightness change but little or no color shift is obtained when the only two used are complementary colors. Thus, as the 405–435 nm (M1) and 565–595 nm (M3) wavelength ranges are complementary colors and the 475–505 nm (M2) and 645–675 nm (M4) wavelength ranges are complementary colors, the four two-component metamer lamps to provide color shift are as follows: M1 with M2, M2 with M3, M3 with M4, and M1 with M4. Of these, the device combining M1 with M4 appears to give the greatest mismatch and therefore appears to be the best, all-around two-component metamer lamps. Particular shades of colors may, however, provide a higher mismatch when illuminated by one of the other two-component metamer lamps and thus different lamps may be appropriate for different colors of objects.

equal in power in all wavelength ranges (which provides a u,v source color of 0.228, 0.309). Calculations show, however, that adjusting of the relative strength of the radiations can result in an increase of mismatches and thus generally better performance as a metamer lamp. The best M1, M2, M3, M4 lamp evaluated (designated M1, M2, M3, M4-10 has approximately a 0.353, 0.221 u,v source color. FIG. 5 shows the spectral power distribution of such a lamp with idealized phosphors and FIG. 6 shows it with certain real phosphors.

While both the $x,y$ diagram and the $u,v$ diagram are commonly used for describing colors, the $u,v$ diagram is more uniform (the minimum perceptible color shift expressed in units of $u,v$ is more nearly constant over the area of the diagram) and will be used in describing the results of the evaluation of different matamer lamps.

Two methods of evaluating a metamer lamp are (1) the "average color shift" (between the samples which match in daylight) observed when the samples are viewed under the metamer lamp and (2) the effectiveness of the metamer lamp in producing at least the "minimum perceptible color difference" between pairs of samples. Evaluations were made with 317 pairs of real materials with reflected-light spectral power distributions which had been found to match under normal daylight. The evaluation of these 317 pairs is summarized in Table I.

TABLE I

| Illuminant | Source Color u | Source Color v | Average Color Shift | Pairs With No Perceptible Color Difference |
|---|---|---|---|---|
| Daylight | .197 | .311 | 0.3 | 317 |
| Cool white halophosphate | .221 | .339 | 3.1 | 129 |
| Incandescent | .256 | .350 | 6.7 | 66 |
| Mercury | .182 | .323 | 5.1 | 39 |
| Color corrected mercury | .236 | .338 | 5.4 | 55 |
| H.P. Sodium | .301 | .358 | 3.9 | 107 |
| M1, M2, M3, M4 | .228 | .309 | 8.2 | 24 |
| M1, M2, M3, M4–2 | .295 | .339 | 17.6 | 15 |
| M1, M2, M3, M4–3 | .221 | .331 | 7.5 | 29 |
| M1, M2, M3, M4–4 | .212 | .259 | 16.1 | 9 |
| M1, M2, M3, M4–5 | .293 | .268 | 22.6 | 7 |
| M1, M2, M3, M4–6 | .163 | .256 | 14.7 | 13 |
| M1, M2, M3, M4–7 | .233 | .209 | 12.1 | 15 |
| M1, M2, M3, M4–8 | .299 | .224 | 25.2 | 5 |
| M1, M2, M3, M4–9 | .336 | .277 | 26.5 | 9 |
| M1, M2, M3, M4–10 | .353 | .221 | 30.9 | 4 |
| M1, M2, M3 | .206 | .307 | 10.7 | 19 |
| M1, M3, M4 | .283 | .320 | 14.4 | 7 |
| M2, M3, M4 | .225 | .346 | 9.2 | 22 |
| M1, M2, M4 | .176 | .208 | 25.4 | 4 |
| M1, M2 | .107 | .186 | 22.3 | 14 |
| M2, M3 | .201 | .346 | 11 | 35 |
| M3, M4 | .289 | .371 | 14 | 33 |
| M1, M4 | .364 | .122 | 40.5 | 9 |
| M1, M2, M3, M4–10 real | .351 | .221 | 26.8 | 7 |
| M1, M2, M4 real | .175 | .208 | 10 | 16 |
| M1, M4 reel | .250 | .220 | 20.2 | 11 |

Metamer lamps can also be conveniently made using radiations in three of the color mismatch accentuating wavelength ranges. In fact, one of the best theoretical (using idealized phosphors with narrow, bell-shaped, spectral energy distributions) lamps is apparently one combining radiations of the M1, M2, and M4 wavelength ranges.

Figure 1:
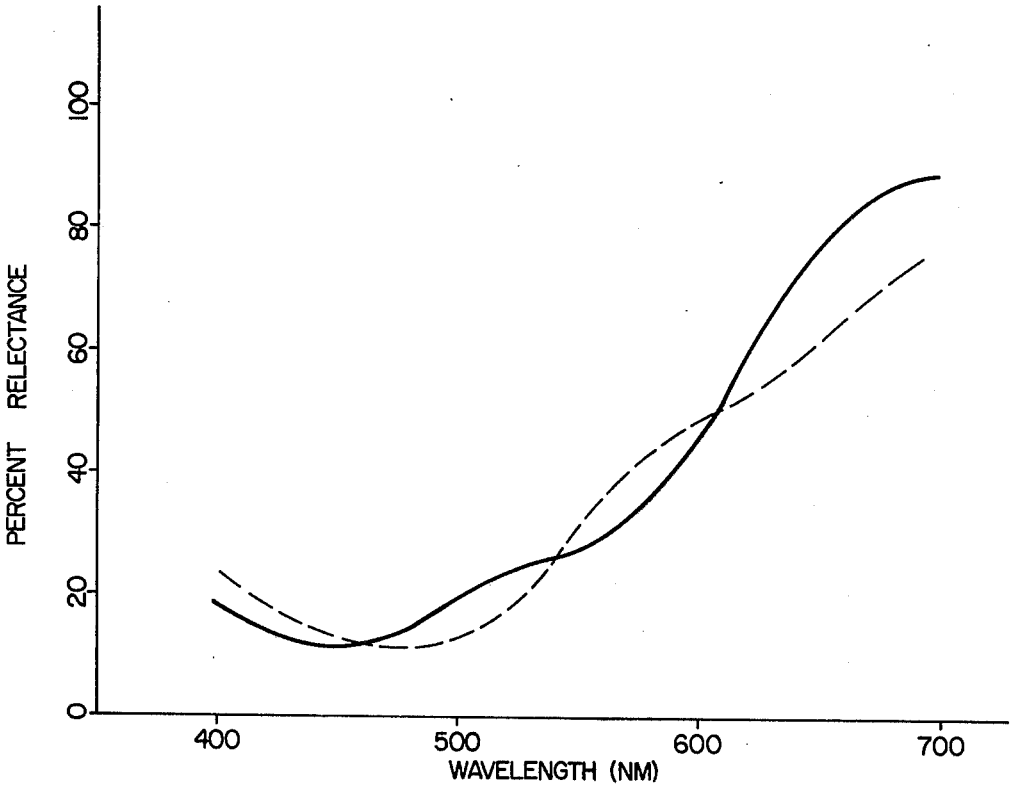
FIG. 1 is a graph of the spectral reflectance curves (percent reflectance plotted against wavelength, in nanometers) measured from two yellow materials found to match in color and lightness when illuminated by average daylight.
Figure 2:
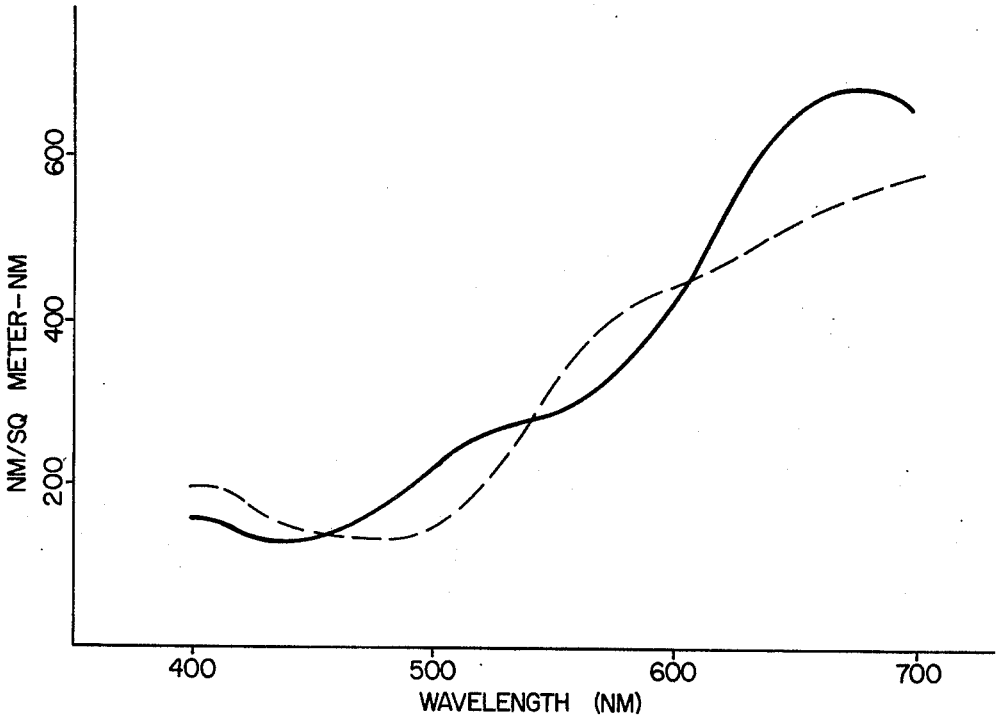
FIG. 2 is a graph of spectral power distributions of the lights reflected from the materials of FIG. 1 when illuminated by average daylight.
Figure 3:
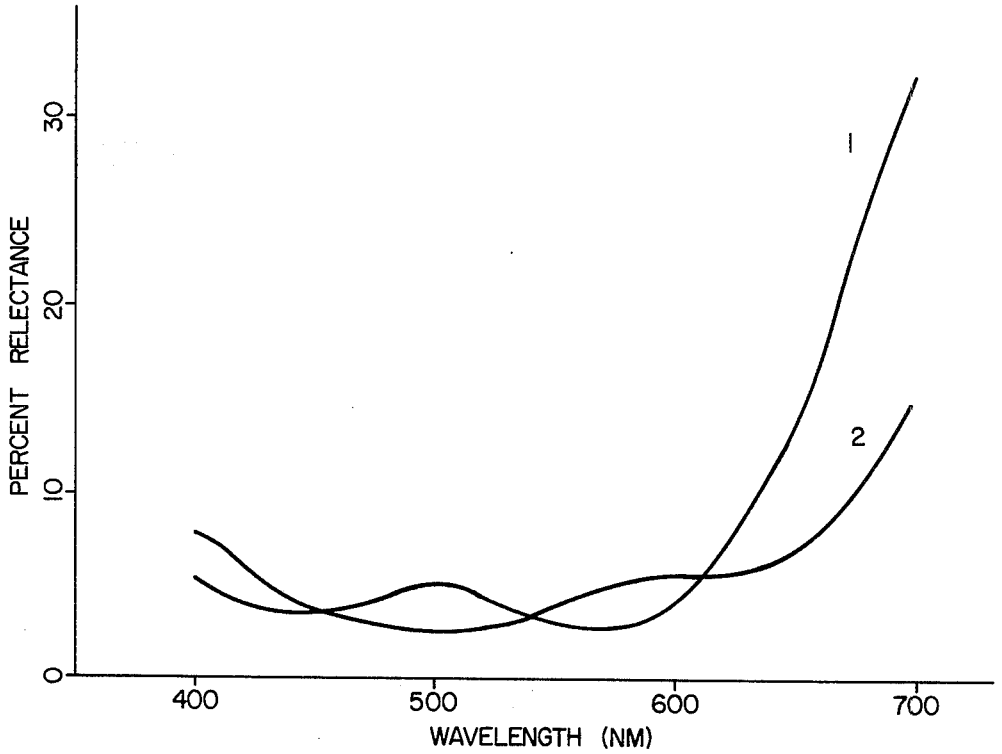
FIG. 3 is a graph of the spectral reflectance curves of two pinkish-grey materials that match in color and lightness when illuminated by average daylight.
Figure 4:
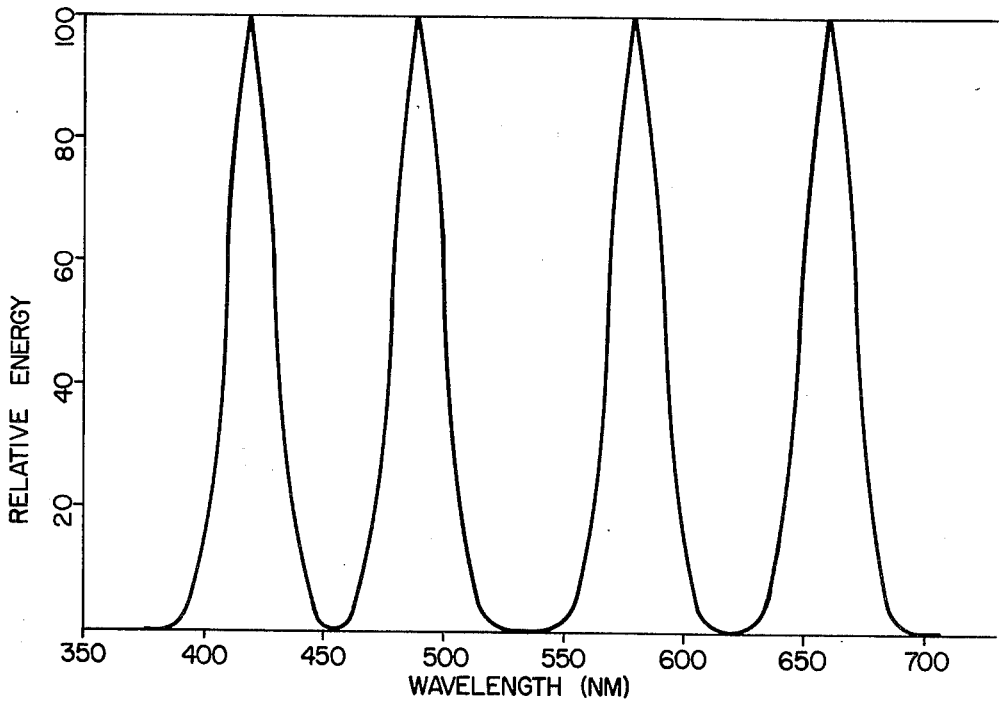
FIG. 4 is a graph of spectral power distribution of a four-component metamer lamp using idealized phosphors having equal radiations in the four metamer wavelength ranges.

Metamer lamps can have radiations in all four of the color mismatch accentuating wavelength ranges (M1, M2, M3, M4). One such configuration of metamer lamp (with radiations of idealized phosphors in all four of the color mismatch accentuating wavelength ranges) is shown in FIG. 4. The radiations are approximately The "average color shift" figure given for the various types of lamps is in thousands of $u,v$ units and it should be noted that this is an average figure for the particular 317 pairs of colors (of actual objects) and would, of course, vary with the pairs of colors actually used. Further, the $u,v$ diagram is not completely uniform and this non-uniformity is especially predominant in the purple region and thus the M1, M4 metamer lamp, while still a good metamer lamp, is probably not quite as good as would be indicated by the "average color shift"figure.

Perhaps the more appropriate evaluation of the performance of the metamer lamp is its ability to produce a "minimum perceptible color difference" (for a human observer) between objects which appear generally similar in color under illumination by daylight. As noted previously the minimum perceptible color difference observable varies even over the $u,v$ diagram, but has been found to be approximately 0.002 over much of the diagram (thus an object of chromaticity $u = 0.300$, $v = 0.300$ would be barely perceptibly different from one of $u = 0.302$, $v = 0.300$). Therefore the number of pairs in Table I with a calculated color shift of less than 0.002 is the number of "Pairs With No Perceptible Color Difference." The 317 pairs were originally selected by human observers as matching in daylight, and all were calculated to have less than 0.002 color difference in day-light. Under an incandescent lamp, calculations indicated that 66 pairs would still appear to match. It should be noted that 251 of the pairs which matched under daylight did not match under incandescent lamps. This illustrates the magnitude of the problem of colors which match under one common illuminant but do not match under another.

Of the special metamer lamps shown in Table I, all provide significantly better detection of potential mismatches than the prior art lamps and both the M1, M2, M4 and the M1, M2, M3, M4-10 lamps (using idealized phosphors) produced at least a minimum perceptible color shift in 313 of the 317 pairs. In addition, it is quite unlikely that color pairs which matched under a special metamer illuminant would ever be placed in an illuminant under which they did not match.

Nine basic types of special metamer lamps (one with all four of the wavelength ranges, four with three of the four wavelength ranges and four with two of the wavelength ranges) can be made. Within each basic type variations can be made using different amounts of radiation in the various wavelength ranges. Table I includes nine theoretical lamps having unequal radiations in the four wavelength ranges (M1, M2, M3, M4-2 through M1, M2, M3, M4-10). Variations in strength of radiations in the various ranges could also be made in lamps with two or three color mismatch accentuating wavelength ranges.

The calculations of Table I ("average color shift" and number of pairs with no perceptible color difference) for metamer lamps other than those marked "real" are based on theoretical bell shaped distributions in each of the wavelengths ranges (such as shown in FIGS. 4 and 5). All of the evaluations are calculations, based on measured spectral reflectance curves of actual objects and on source spectral energy distributions.

Table I also includes calculations based on the spectral power distributions of actual phosphors in real lamps. Metamer lamp M1, M2, M3, M4-10 (real) utilizes a phosphor mix to provide the four color-mismatch-accentuating emissions. This phosphor mix consists of approximately 38 percent (by weight) of strontium orthophosphate activated by divalent europium (to provide the M1 range), 2 percent yttrium vanadate activated by trivalent dysprosium (to supply both the M2 and the M3 ranges), and 60 percent magnesium fluorogermanate activated by 4+ manganese (to supply the M4 range). This mix produces the spectral energy distribution shown in FIG. 6 and provides the best performance of any real metamer lamp evaluated.

Metamer lamp M1, M4 (real) is an example of a lamp having only two color mismatch accentuating wavelength ranges. The phosphor mix of lamp M1, M4 (real) consists of approximately 70 percent strontium orthophosphate activated by divalent europium (emitting principally in the M1 range) and 30 percent magnesium fluorogermanate activated by 4+ manganese (supplying the M4 radiations).

Lamp M1, M2, M4 (real) does not provide nearly as good as performance as the theoretical M1, M2, M4 lamps, and this is probably due to the use of a relatively wide-band M2 phosphor. Its phosphor mix used 51 percent (by weight) strontium orthophosphate activated by divalent europium (providing the M1 radiation), 42 percent strontium silicate activated by europium (to provide the M2 radiation), and 7 percent magnesium fluorogermanate activated by 4+ manganese (to supply the M4 radiation). Substitution of a more narrow-band emitting phosphor, such as magnesium gallate activated by manganese, might improve the performance.

Other phosphors can, of course, be substituted for others of the aforementioned phosphors. For example, strontium pyrophosphate activated by europium could be substituted for the strontium orthophosphate and $LaSiO_3Cl$:Dy can be substituted (to supply both the M2 and M3 emissions) for the yttrium vanadate.

It has been found that radiation in certain wavelength ranges tends to perpetuate a color match and thus such radiations should be avoided in a metamer lamp. In particular it has been found that the 435–465 nm, 525–555 nm, and 595–625 nm wavelength ranges (the "prime color" ranges) tend to prevent observation of the color differences and preferably the radiations of a metamer lamp in these "prime color" regions should be minimized. As real phosphors often have relatively broad spectrums it is often impractical to completely eliminate radiations in any given regions, but preferably the radiations in these regions should be held to less than about 20 percent of the total visible radiations.

As used herein for describing the visible radiations in certain wavelength ranges, the term "substantially confined" means that the energy in those regions is at least 50 percent of the total energy in the visible radiations. Thus while a theoretical metamer lamp would have essentially all of its visible radiations within the color mismatch accentuating wavelength ranges and none in the "prime color" regions, this is generally impractical with real phosphors and it has been found that satisfactory metamer lamps are produced when greater than 50 percent of the visible radiations are in the metamer ranges (especially when less than 20 percent is in the "prime color" regions).

Table II is a listing of typical percentages of radiations (as a percentage of the total radiation between 400 nm and 700 nm) in the metamer regions and also in the three "prime color" regions (P1, P2, P3). Table II includes both prior art lamps (a cool white halophosphate type fluorescent lamp, a 150 watt incandescent lamp, 400 watt corrected and uncolor corrected high pressure mercury lamps, and a 400 watt sodium lamp), as well as of real phosphor metamer lamps of the present invention (metamer lamps M1, M2, M4 real; M1, M4 real and M1, M2, M3, M4-10 real).

TABLE II

| Illuminant | M1 | M2 | M3 | M4 | Total M1–M4 | P1 | P2 | P3 | Total P1–P3 |
|---|---|---|---|---|---|---|---|---|---|
| Daylight | 5% | 9% | 9% | 9% | 32% | 7% | 9% | 8% | 24% |
| Cool white halophosphate | 9 | 7 | 20 | 4 | 40 | 9 | 14 | 13 | 36 |
| Incandescent | 2 | 5 | 10 | 15 | 32 | 3 | 8 | 11 | 22 |
| H.P. Mercury | 11 | 2 | 22 | 0 | 35 | 9 | 19 | 2 | 30 |
| Color Corrected Mercury | 12 | 2 | 20 | 2 | 36 | 6 | 17 | 15 | 38 |
| H.P. Sodium | 1 | 4 | 37 | 6 | 48 | 3 | 3 | 28 | 34 |
| M1, M2, M3, M4–10 real | 25 | 1 | 2 | 37 | 65 | 4 | 3 | 3 | 10 |
| M1, M2, M4 real | 33 | 11 | 2 | 9 | 55 | 11 | 6 | 1 | 18 |
| M1, M4 real | 31 | 0 | 4 | 23 | 58 | 5 | 10 | 2 | 17 |

Figure 7:
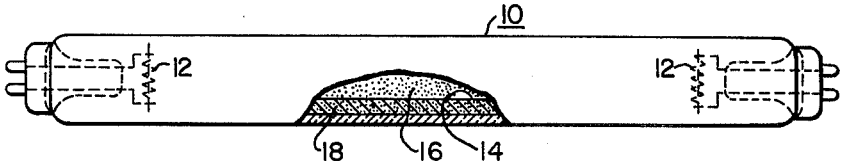

While other types of devices (such as combinations of lasers or LEDs) or other types of discharge lamps (such as high pressure mercury lamps with appropriate phosphors) can be used to generate the radiations to provide the desired spectral energy distribution, a low pressure mercury discharge fluorescent lamp is preferred. With reference to FIG. 7, there is shown a fluorescent lamp, wherein a conventional, elongated, tubular, soda-lime glass envelope 10 has operative discharge sustaining electrodes at opposite ends. The discharge sustaining material comprises mercury 14 and inert gas filling 16 as is well known in the art. A phosphor layer 18 is disposed on the inner surface of the envelope 10. In such a configuration, the phosphor layer 18 is the primary light generating medium and the electrodes 12 together with the discharge sustaining material comprise means for producing electrical discharge within the envelope 10. The electrical discharge energizes the phosphor layer 18 to a light generating condition. The phosphor layer 18 and the electrical discharge are adapted to emit (through the envelope 10) radiation having a spectral energy distribution such that the visible radiations are substantially confined to at least two of the following wavelength ranges: 405–435 nm, 475–505 nm, 565–595 nm, and 645–675 nm. Typically the phosphor layer 18 consists of a mixture of phosphors, however metamer lamps can be fabricated using a single phosphor which radiates in two metamer regions (yttrium vanadate activated by trivalent dysprosium, for example, radiates in both the M2 and M3 regions).

A typical inspection procedure for a manufacturer who wishes to assure that colors would indeed match under essentially all illumination conditions, might involve, for example, the following steps. The first step would be the initial matching of the colors under a daylight type illumination. The second step would be to check for a mismatch using a metamer lamp such as the four-metamer-region lamp (metamer lamp M1, M2, M3, M4-10) described. If mismatches are detected using the metamer lamp, appropriate process changes (such as additions to the dyes) could be made. In some cases, it might be convenient to use specially selected two-metamer region lamps to analyze what type of process change would be most appropriate.

I claim:

1. A device which generates light of a quality which will accentuate the mismatch in color appearance of objects having different spectral reflectance curves but which appear at least generally similar in color under illumination by daylight, said device comprising:

a. a light generating medium for generating visible radiations which are substantially confined to at least two of the four color mismatch accentuating wavelength ranges and which are not substantially confined to two complementary color wavelength ranges, said color-mismatch-accentuating wavelength ranges consisting of:
   i. from 405 to 435 nm,
   ii. from 475 to 505 nm,
   iii. from 565 to 595 nm,
   iv. from 645 to 675 nm; and b. means for energizing said light generating medium to a light generating condition.

2. The device of claim 1, wherein less than 20 percent of the visible radiations are in the 435–465 nm, 525–555 nm, and 595–625 nm wavelength ranges.

3. The device of claim 2, wherein said radiations are substantially confined to two of said color mismatch accentuating wavelength ranges.

4. The device of claim 2, wherein radiations in all four of said color-mismatch-accentuating wavelength ranges are utilized.

5. The device of claim 2, wherein said radiations are substantially confined to three of said color-mismatch-accentuating wavelength ranges.

6. The device of claim 5, wherein said radiations are substantially confined to the 405–435 nm, 475–505 nm and 645–675 nm wavelength ranges.

* * * * *